US007185460B2

(12) United States Patent
Corden

(10) Patent No.: US 7,185,460 B2
(45) **Date of Patent: *Mar. 6, 2007**

(54) FREE-STANDING PANEL WALL SYSTEM

(76) Inventor: David A. Corden, 7705 Wilmington Dr., Knoxville, TN (US) 37919

( * ) Notice: Subject to any disclaimer, the term of this patent is extended or adjusted under 35 U.S.C. 154(b) by 0 days.

This patent is subject to a terminal disclaimer.

(21) Appl. No.: 11/079,850

(22) Filed: Mar. 14, 2005

(65) Prior Publication Data

US 2005/0166469 A1 Aug. 4, 2005

Related U.S. Application Data

(60) Division of application No. 10/459,857, filed on Jun. 12, 2003, now abandoned, which is a continuation-in-part of application No. 10/001,110, filed on Nov. 2, 2001, now Pat. No. 6,601,349.

(51) Int. Cl.
*E04B 2/74* (2006.01)

(52) U.S. Cl. ..... 52/36.5; 52/220.7; 52/241; 52/481.2

(58) Field of Classification Search ..... 52/36.5, 52/241, 762, 242, 481.2, 144, 384, 220.7
See application file for complete search history.

(56) References Cited

U.S. PATENT DOCUMENTS 2,037,889 A 4/1936 Doud
3,814,034 A * 6/1974 Seiz ..... 108/187
3,934,382 A 1/1976 Gartung
4,034,463 A 7/1977 Ryan
4,118,903 A 10/1978 Coulthard
4,370,838 A 2/1983 Vermillion
4,459,790 A 7/1984 Vermillion
4,651,484 A 3/1987 Rutkowski
4,991,368 A 2/1991 Amstutz
5,216,859 A 6/1993 Moreno et al.
5,341,615 A 8/1994 Hodges et al.
5,412,919 A 5/1995 Pellock et al.
5,440,854 A 8/1995 Hohmann
5,487,246 A * 1/1996 Hodges et al. ..... 52/220.7
5,791,093 A 8/1998 Diamond
6,115,977 A 9/2000 Hornberger et al.
6,226,947 B1 5/2001 Bado et al.
6,425,219 B1 7/2002 Barmak et al.
6,601,349 B1 * 8/2003 Corden ..... 52/36.5

* cited by examiner

*Primary Examiner*—Basil Katcheves
(74) *Attorney, Agent, or Firm*—Pitts & Brittian, PC

(57) ABSTRACT

A free-standing panel wall system adapted for selectively and adjustably mounting wall panels on either or both sides thereof. The wall system includes generally a plurality of horizontally disposed rails, a plurality of vertical supports carried on either or both sides of the horizontal rails, and a registration mechanism for selectively positioning the horizontal rails and vertical supports relative to each other. Each of the horizontal rails defines a plurality of equally spaced-apart first openings. Each of the upright supports defines a plurality of equally spaced-apart second openings. The first and second openings cooperate to receive conventional fasteners such that the horizontal rails are incrementally adjustable along the vertical supports, and the vertical supports are incrementally adjustable along the horizontal rails.

16 Claims, 4 Drawing Sheets

FREE-STANDING PANEL WALL SYSTEM

CROSS-REFERENCE TO RELATED APPLICATIONS

This is a division of application Ser. No. 10/459,857, filed Jun. 12, 2003 now abandoned, which is a continuation-in-part of application Ser. No. 10/001,110, filed Nov. 2, 2001, now U.S. Pat. No. 6,601,349, issued on Aug. 5, 2003.

STATEMENT REGARDING FEDERALLY SPONSORED RESEARCH OR DEVELOPMENT

Not Applicable

BACKGROUND OF THE INVENTION

1. Field of Invention

This invention relates to removable panel wall systems of the type commonly employed for the display of merchandise in retail establishments or as "temporary" enclosures (at times referred to as "cubicles") which are located interiorly of a permanent building for occupancy by personnel or for storage purposes.

2. Description of the Related Art

Commonly, panel wall systems comprise horizontal stringers or channels which are secured to the interior wall of a retail establishment, vertical standards which are secured to the stringers, and planar panels which are secured to the standards. This structure provides the background for the display of merchandise which is exhibited on shelves that are supported by brackets that are mounted on, and which project outwardly from, the panel wall system.

It is frequently desired that a panel wall system be free-standing, that is, the system is not anchored to either the ceiling or the wall of the retail establishment so that the system may be relocated within the establishment without reference to the permanent walls of the establishment. Thus, in free-standing panel wall systems, the system rests on the floor of the establishment. In certain prior art instances, the system is retained against tipping by the structural, design of the system, such as through the means of horizontal legs that are attached to the bottom of the panel wall system and which project laterally from the wall system to provide lateral anti-tipping support to the wall system. Such structural members present obstacles to the flow of customer or worker traffic, including the possibility of customers or workers tripping over the lateral projections. In other instances, the panel wall system may be stabilized against tipping over by embedding relatively large and strong posts in the floor of the establishment such that these posts extend upwardly from the floor and serve to anchor the wall system to the floor. This concept is frequently employed when the floor of the establishment comprises concrete. This concept for stabilizing the wall system against tipping requires destructive modification of the floor, is expensive to install and otherwise tends to inhibit relocation of the wall system, a most undesired result.

In one embodiment, free-standing panel wall systems desirably provide for the display of merchandise on shelves which are provided on both the front and rear sides of the wall system. This desired feature of the wall system requires that the panel wall system provide for the support of shelving on both the front and rear upright faces of the system. This desirable feature imposes upon a free-standing wall system the need for enhanced strength to provide stable support of merchandise that rests on shelves that are cantilevered from the opposite surfaces of the wall system. Notably, the overall weight of the merchandise displayed on the shelves on the front surface of the wall system may not be, and frequently is not, of the same or nearly the same, overall weight as the merchandise displayed on the shelves on the rear surface of the wall system. Thus, this factor imposes an even more demanding requirement relative to the strength and stability of a free-standing panel wall system. In another embodiment, removable free-standing panel wall systems comprise enclosures (cubicles) for housing personnel or for storage, all disposed within a permanent building, but being independent of the fixed walls of the building. These panel wall systems desirably are to be readily constructed in situ and readily removable, both at minimum expense and damage to the permanent building.

Further, known prior art free-standing panel wall systems are constructed of materials which are not fireproof or fire-resistant, partly due to the difficulty of initially installing and subsequent dismantling of the system for movement to a new location within the establishment and again installing the system at its new location.

Other devices have been developed. Typical of the art are those devices disclosed in the following U.S. patents:

| U.S. Pat. No. | Inventor(s) | Issue Date |
|---|---|---|
| 2,037,889 | A. N. Doud | Apr. 21, 1936 |
| 3,934,382 | C. W. Gartung | Jan. 27, 1976 |
| 4,034,463 | R. E. Ryan | Jul. 12, 1977 |
| 4,118,903 | J. A. Coulthard | Oct. 10, 1978 |
| 4,370,838 | E. F. Vermillion | Feb. 1, 1983 |
| 4,459,790 | E. F. Vermillion | Jul. 17, 1984 |
| 4,651,484 | E. J. Rutkowski | Mar. 24, 1987 |
| 4,991,368 | D. D. Amstutz | Feb. 12, 1991 |
| 5,216,859 | J. L. Moreno et al. | Jun. 8, 1993 |
| 5,341,615 | R. R. Hodges et al. | Aug. 30, 1994 |
| 5,412,919 | M. A. Pellock et al. | May 9, 1995 |
| 5,440,854 | R. P. Hohmann | Aug. 15, 1995 |
| 5,791,093 | G. C. Diamond | Aug. 11, 1998 |
| 6,115,977 | T. G. Hornberger et al. | Sep. 12, 2000 |
| 6,226,947 | J. J. Bado et al. | May 8, 2001 |
| 6,425,219 | J. Barnak et al. | Jul. 30, 2002 |

BRIEF SUMMARY OF THE INVENTION

A free-standing panel wall system is disclosed. The present invention is provided for selectively and adjustably mounting wall panels on either or both sides of a free-standing panel wall system. The present invention includes generally a plurality of horizontally disposed rails, a plurality of vertical supports carried on either or both sides of the horizontal rails, and a registration mechanism for selectively positioning the horizontal rails and vertical supports relative to each other. Specifically, the horizontal rails are incrementally adjustable along the vertical supports, and the vertical supports are incrementally adjustable along the horizontal rails. Thus, panels are used that are dimensioned in view of the incremental registration between the horizontal rails and the vertical support.

The plurality of horizontal rails includes at least an elongated bottom rail and an elongated top rail. Each horizontal rail defines first and second opposing faces. Each of the first and second faces defines a plurality of equally spaced-apart first openings.

A plurality of first upright supports is configured to engage the first face of each of the horizontal rails. Similarly, a plurality of second upright supports is configured to engage the second face of each of the horizontal rails. A plurality of equally spaced-apart second openings is defined in each of first and second upright supports. The horizontal rail first openings and the vertical support second openings cooperate to receive a conventional fastener.

The vertical supports are incrementally adjustable along the length of the horizontal rails. Further, the horizontal rails are incrementally adjustable along the height of the vertical supports. Thus, the first and second openings cooperate to define the registration mechanism.

At least one substantially planar panel member is interposed between adjacent first or second upright supports.

A plurality of free-standing panel walls of the present invention may be used in combination with each other to define any selected configuration or wall arrangement.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A free-standing panel wall system is disclosed. The present invention is provided for selectively and adjustably mounting wall panels on either or both sides of a free-standing panel wall system. The present invention includes generally a plurality of horizontally disposed rails, a plurality of vertical supports carried on either or both sides of the horizontal rails, and a registration mechanism for selectively positioning the horizontal rails and vertical supports relative to each other. Specifically, the horizontal rails are incrementally adjustable along the vertical supports, and the vertical supports are incrementally adjustable along the horizontal rails. Thus, panels are used that are dimensioned in view of the incremental registration between the horizontal rails and the vertical support.

Figure 1:
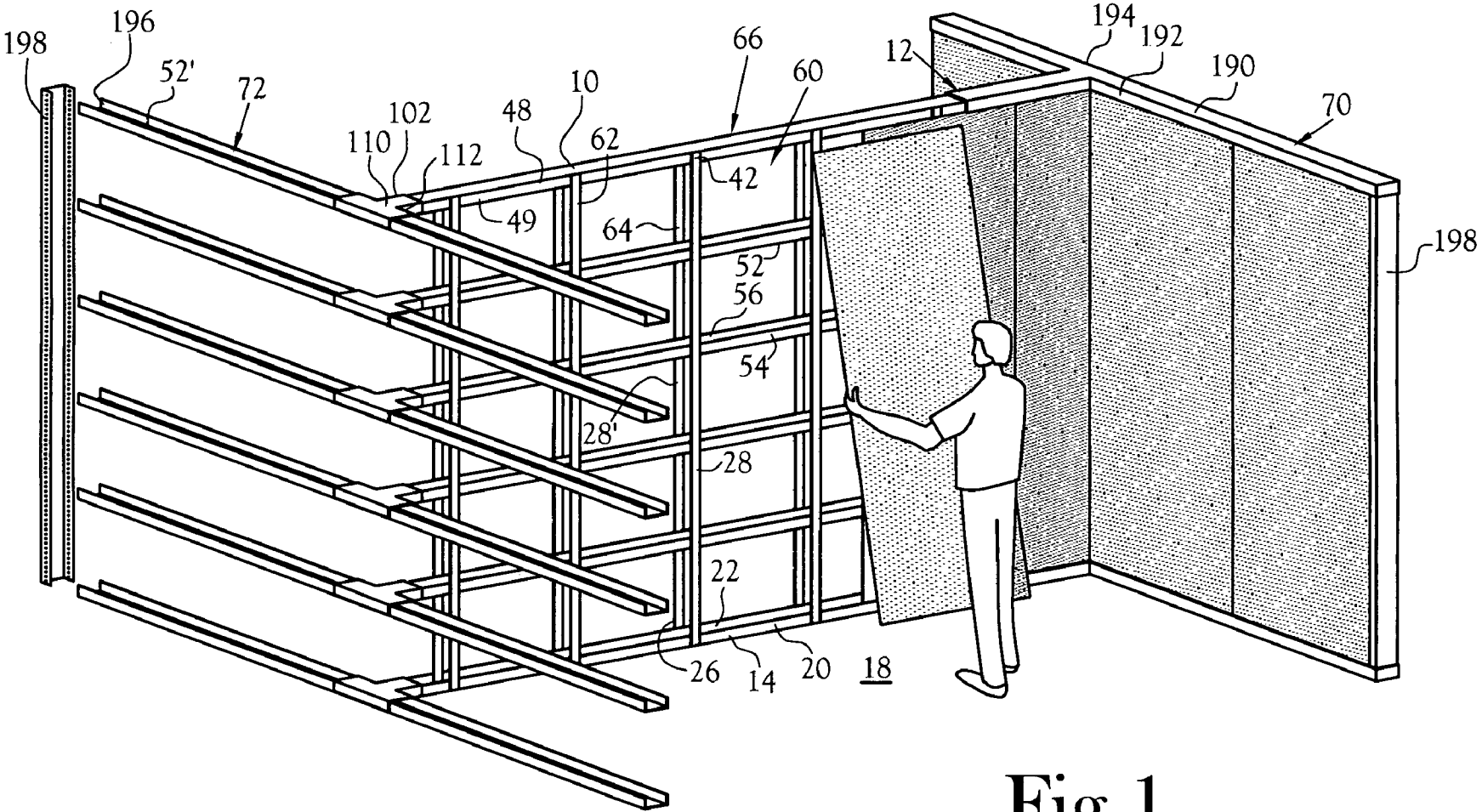
FIG. 1 is a representation of one embodiment of a free-standing panel wall embodying various of the features of the present invention.

As illustrated in FIG. 1, the plurality of horizontal rails includes at least an elongated bottom rail 14 and an elongated top rail 48. Also illustrated is a plurality of intermediate horizontal rails 52. Each horizontal rail 14, 48, 52 of the illustrated embodiment defines a substantially U-shaped configuration defining first and second opposing faces 20, 22, 44, 46 and 54, 56, respectively. Each of the first and second faces 20, 22, 44, 46 and 54, 56 defines a plurality of equally spaced-apart first openings 50.

A plurality of first upright supports 28 is configured to engage the first face 20, 44, 54 of each of the horizontal rails 14, 48, 52. Similarly, a plurality of second upright supports 28 is configured to engage the second face 22, 46, 56 of each of the horizontal rails 14, 48, 52. Each of the first and second upright supports 28 is configured to define a transverse cross section selected from at least a substantially U-shaped configuration and a substantially T-shaped configuration. A plurality of equally spaced-apart second openings 50' is defined in each of first and second upright supports 28. The horizontal rail first openings 50 and the vertical support second openings 50' cooperate to receive a conventional fastener 51.

Because the first openings 50 are equally spaced-apart, as well as the second openings 50', it will be seen that the vertical supports 28 are incrementally adjustable along the length of the horizontal rails 14, 48, 52, and that the horizontal rails 14, 48, 52 are incrementally adjustable along the height of the vertical supports 28. Thus, the first and second openings 50, 50' cooperate to define the registration mechanism.

At least one substantially planar panel member is interposed between adjacent first or second upright supports 28. Because the first openings 50 defined by the horizontal rails 14, 48, 52 are equally spaced-apart, the width of each panel is a standard width, dictated by the spacing of the first openings 50. Specifically, for horizontal rails 14, 48, 52 defining a first opening 50 spacing of one inch (1"), the width of standardized panels is also incremented in one inch steps.

As illustrated in FIG. 1 and more clearly described below, a plurality of free-standing panel walls 10 of the present invention may be used in combination with each other to define any selected configuration or wall arrangement. Also as illustrated in FIGS. 2–9 and as described below, connectors configured to join respective horizontal rails of two or more free-standing panel walls 10 of the present invention are provided.

Figure 2:
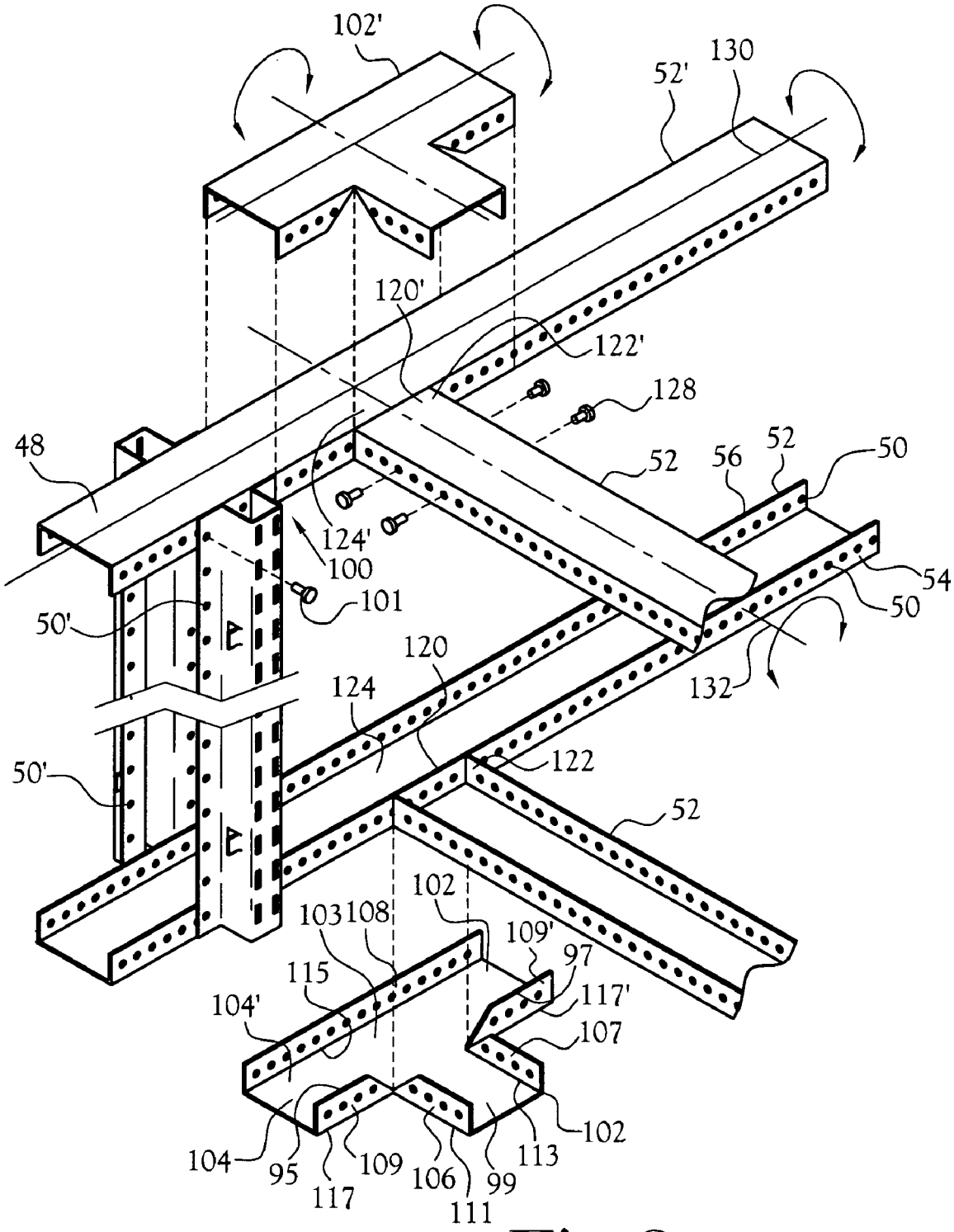
FIG. 2 is a representation of a portion of a panel wall system embodying cap members mountable at various intersections of various channel members in one embodiment of the present invention.
Figure 3:
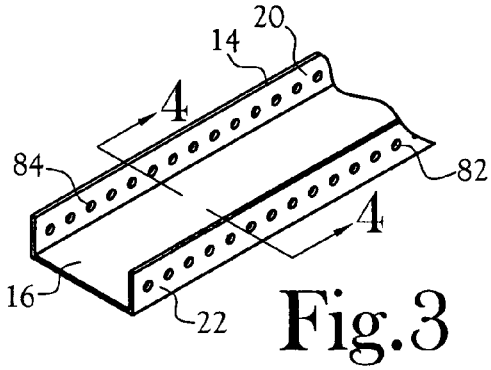
FIG. 3 is a representation of a portion of an elongated channel member suitable for use in the present invention.
Figure 4:
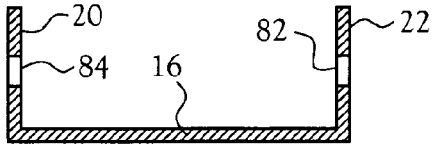
FIG. 4 is a cross-sectional view of the channel member depicted in FIG. 3 and taken generally along the line 4—4 of FIG. 3.
Figure 10:
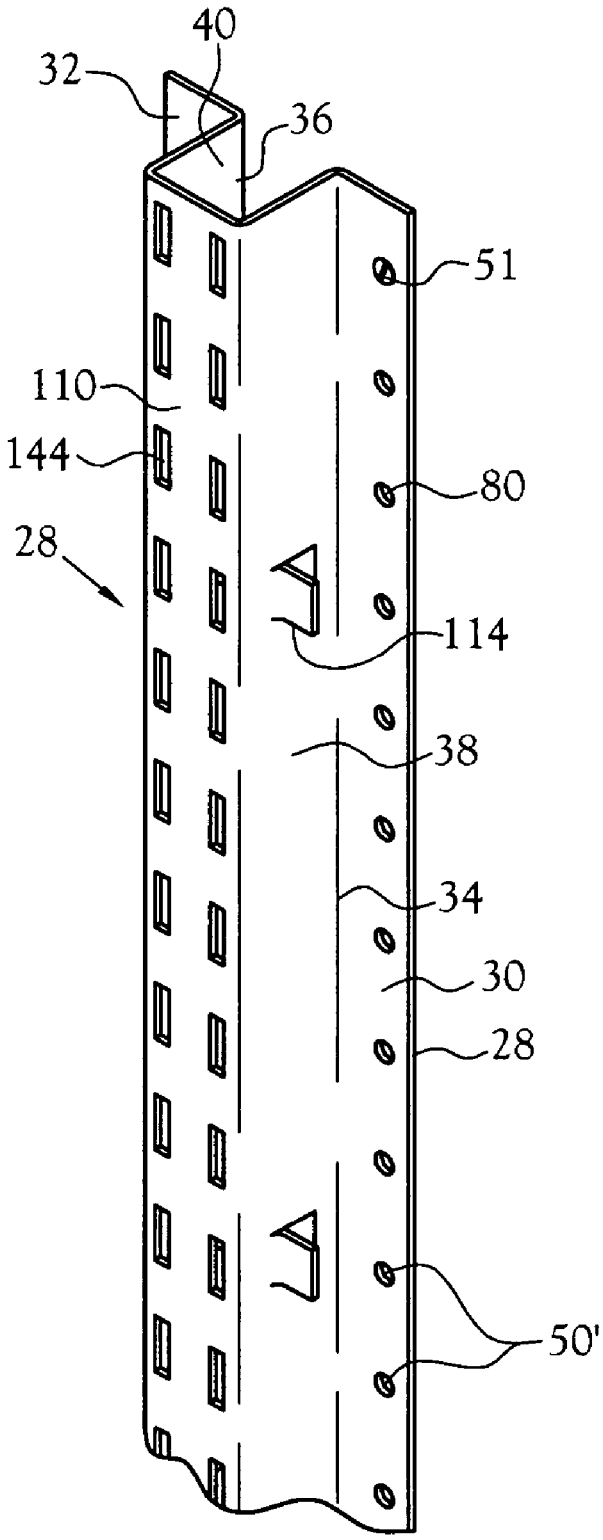
FIG. 10 is a representation of one embodiment of a standard useful in the present invention.

Referring to FIGS. 1, 2 and 10, in accordance with one embodiment of the present invention, there is provided a free-standing panel wall system 12 which is both strong and stable. A main section 10 of the present wall system comprises at least one substantially rigid and generally U-shaped (in cross section) floor rail 14, the face web 16 of which lies flat on, and, as needed, may be anchored to, the floor 18 of an establishment with its opposite side webs 20, 22 projecting upwardly from the floor. The width of the face web of the floor rail is chosen to provide for the placement of floor anchors spaced apart laterally on the face web to provide laterally spaced apart points of anchoring of the floor rail to the floor. In other embodiments of the present panel wall system, no anchoring of the wall system to the floor is required.

At spaced apart locations along the length of the floor rail, there are received the bottom ends 26 of a plurality of rigid wall standards 28, (FIGS. 2 and 10) each being of a generally U-shaped cross section, and including generally planar wings 30, 32 which extend laterally from the distal edges 34, 36 of each of the side webs 38, 40 of the standard and provided with holes 50 through the thickness thereof and spaced uniformly and equally spaced apart along the length of each wing. The opposite lateral wings 30, 32 of each standard are disposed externally of the floor rail and are disposed alongside and substantially parallel to the plane of their respective one of the upstanding side webs 20, 22 of the floor rail. These bottom ends 26 of the standards 28 are releasably anchored to respective ones of side webs 20, 22 of the floor rail as by screws or other suitable removable fastener 51 which pass through registered ones of the holes 50 in the wings of the standard and like holes through the thickness of the side webs of the floor rail. The top ends 42 of the standards 28 are likewise disposed externally of the side webs 44, 46 of a top rail 48 which is generally U-shaped in cross section with opposite side webs like the floor rail, but with its side webs projecting downwardly of the wall system. The top ends 42 the standards 28 are releasably anchored to a side web of the top rail as by screws, bolts or other suitable releasable fasteners. In one embodiment of the present invention there is provided on the front face 60 of the main wall section 10 a plurality of standards 28 which comprise a first set 62 of standards. A second set 64 of like standards made up of standards 28' is provided on the rear face 66 of the main wall section.

At locations intermediate the floor and top rails, the present wall system includes a plurality of horizontal channel members 52, each of which is substantially rigid and of a generally U-shaped cross section, which may be, but need not be, substantially the same in shape and size as the cross section of the floor rail 14. Each channel member includes legs 54, 56 which are oriented either upwardly or downwardly from the face web 58 of the channel member. As depicted, each leg of each channel member is planar and in the nature of a web. In the embodiment depicted in FIG. 2, each channel member is interposed between the first set of standards 28 on the front face 60 of the wall system and the second set of standards 28' on the rear face of the wall system, the standards preferably being disposed directly across the wall system from one another. Each leg 54, 56 of each channel member 52 is disposed in substantially planar relationship to the planar wings of its associated front and rear standards, and each is releasably anchored to at least one, and preferably both, of the planar wings of each of these standards.

By reason of the U-shaped cross section of each channel member, at least two of these channel members may be combined as by nesting or by inverting one channel member and overlapping it onto a further channel member, as desired to enhance the horizontal support strength of the wall system, to permit greater separation distances between adjacent standards and/or to enhance the resistance of the channel member to torque forces. This combined channel members may be fastened to one another and/or to the standards. Still further, the telescopically combined channel members may be extended or shortened to shorten or lengthen the wall section without full disassembly of the wall section.

For purposes of establishing modularity and ease of installation, in the present invention each of the planar wings 30, 32 of each standard and each of the side webs of each of the floor rail, the top rail and the channel members is provided with holes 41, 82 and 84 (typical) through their respective thickness at equally and uniformly spaced apart locations along the length of each such member. For example, holes may be provided one inch on centers along the length of each of the floor rail, top rail, horizontal standard and like-spaced holes may be provided in each of the planar wings 30, 32 of each standard 28. When a hole in or near the bottom end of a standard is in register with a hole in the side web of a floor rail, for example, a screw or bolt or other suitable releasable fastener may be threaded through the registered holes to interconnect the bottom end of the standard to the floor rail. In like manner the intersections 100 (typical) of the channel members may be interconnected employing a removable fastener 101 that is disposed within registering holes in the standards and channel members. Obviously the top rail of the present wall system can be interconnected to the top ends of the standards of the system in like manner.

Whereas the panel wall system of the present invention may reside in a single plane, for example, there are no supporting lateral projections therefrom, in one embodiment, the so-constructed main section 10 of the wall system of the present invention may include one or more laterally extending sections 70, 72. (FIG. 1) For example, a section of the wall system may extend laterally from the main wall section at substantially any location along the length of the main section, and/or from one or both the front and rear faces of the main wall section. That is, one or more lateral sections may be provided at either or both ends of the main section and/or at one or more locations intermediate the opposite ends of the main section.

At those locations along the main section of the present wall system where a lateral section is to be placed, the lateral section may be made up in the form of a "main" section as described hereinabove, and thereafter attached to the main section employing cap members 102.

A suitable channel member 52 of the present invention preferably comprises a length of extruded aluminum having a generally "U"-shaped cross section. The channel member thus includes a face web 16 and first and second opposite legs 20, 22, each leg being in the form of a planar web which extends along the length of the channel member and projects substantially perpendicularly from opposite side margins of the face web. Each of the legs is provided with holes 82 extending through the thickness of the leg and preferably spaced apart equidistantly along the length of the leg. The location of and spacing between these holes of each leg preferably is the same for each leg and chosen to provide for registration of these holes with like holes through the legs of a cap member when a cap member is associated with one or more channel members in the formation of a wall system employing the present channel members and cap members.

Figure 5:
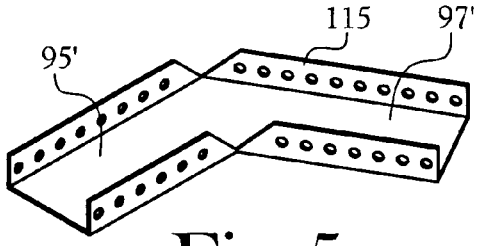
FIG. 5 is a representation of a 135 degree, 2-way, angled cap member useful in the present invention.
Figure 6:
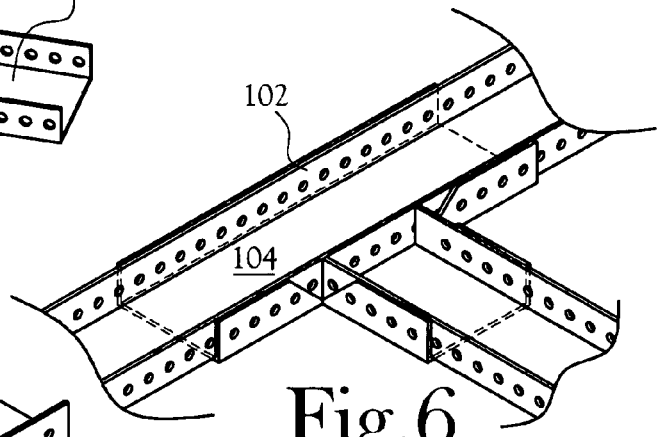
FIG. 6 is a representation of a 90 degree, 3-way, angled cap member useful in the present invention.
Figure 7:
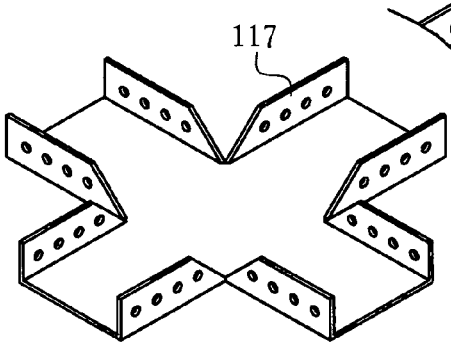
FIG. 7 is a representation of a 90 degree, 4-way, angled cap member useful in the present invention.
Figure 8:
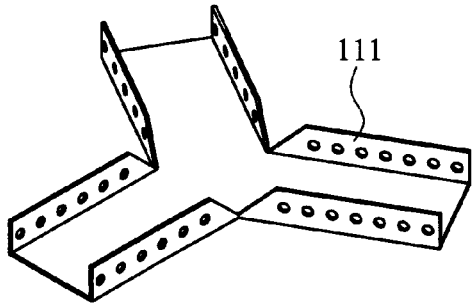
FIG. 8 is a representation of a 120 degree, 3-way, angled cap member useful in the present invention.
Figure 9:
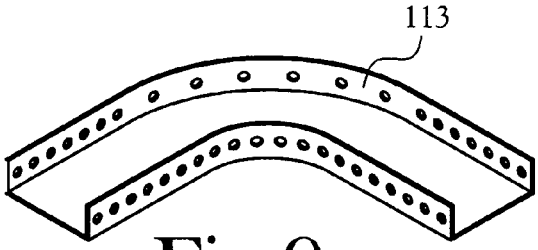
FIG. 9 is a representation of a curved cap member useful in the present invention.

A cap member 102 of the present invention (FIGS. 2 and 5, for example), when viewed in a top or bottom plan view, exhibits a unitary overall face web 104 and at least two lateral extensions 95 and 99 (FIG. 2) and 95', 97' of FIG. 5, emanating from a central location 103 of the cap member. The cap member depicted in FIG. 2 includes a third extension 99. As depicted in FIG. 2, each of these extensions is of a generally "U"-shaped cross section and includes a portion 104' of the unitary face web 104 which extends over the entire face of the cap connector, including the lateral extensions of the cap member. Referring to the embodiment of a cap member 102 as depicted in FIG. 2 each of the lateral extensions of the cap member includes opposite legs 106, 107, 108, 109 and 109' which project substantially perpendicularly from each of the side margins 111, 113, 115, 117 and 117", respectively, of the cap member, each leg comprising a planar web having a plurality of holes through the thickness thereof at equally and uniformly spaced apart locations along each leg in like manner as a channel member 52. As depicted in FIG. 1, this cap member is fitted over and about the intersection 110 of the top rail 48 of a main section of the present wall system and the abutting portion 112 of the top rail 48' of a lateral section 72 of the present wall system. As depicted in FIG. 2, a cap member also is fitted over and about the intersection 120 of an end 122 of a horizontal channel member 52 of the main wall section with a central portion 124 of a horizontal channel member 52' of a lateral wall section. Specifically, in a typical cap member-connected intersection between a first channel member of one wall section with a second channel member of a further wall section, the end 122 of the first channel member is received within the leg extension 99 of the cap member and the central portion 124 of the second channel member is received within the leg extensions 95 and 97. This placement of the cap member in covering relationship to an intersection provides for registration of holes in the side webs of the cap member with holes in the side webs of the first and second channel members. As noted, each cap member is secured to the first and second channel members as by removable fasteners 128, such as screws or bolts threaded through the registering holes to provide for removable interconnection and rigid securement of a lateral section of the wall system to the main section of the wall system. For removably securing lateral sections of the wall system to the main section of the wall system at angles of other than ninety degrees, angled cap members of other geometries, such as 135-degree angled 115 (or other degree of angle) (See FIGS. 5 and 8), Y-shaped 111 (FIG. 8), or curved 113 (FIG. 9), etc. may be employed as needed. Other suitable cap member configurations will be recognized by one skilled in the art such as a 90 degree, 4-way cap member 117 as depicted in FIG. 7.

It will be noted that these angled cap members provide material rigidity to the present wall system in multiple directions and enhance the resistance of the channel members to rotate about their respective longitudinal axes, 130, 132 (FIG. 2) thereby materially contributing to the lack of need in the present wall system for anchoring of the present wall system to either the floor, ceiling or a wall of the establishment. This same desirable effect is obtained when employing the present cap members to attach a lateral wall section to the main wall section at a location at or intermediate the opposite ends of the main wall section. Further, it is noted that a panel wall system constructed employing the channel members and cap members of the present invention is readily erected and dismantled as needed. Moreover, the combination of the channel members and associated cap members has been found to provide exceptional rigidity to a wall panel system, and particularly imparts an unexpected degree of resistance to those forces which normally tend to twist the wall out of its desired upright planar attitude. Such forces are commonly encountered when mounting shelves and the like to one or more of the main and/or lateral sections of the wall.

Whereas the present invention has been described in specific terms and elements, it will be understood by one skilled in the art that equivalent elements, geometrical configurations, and other obvious modifications may be made without departing from the scope of the invention. For example, it will be recognized by one skilled in the art that any of several possible modes of releasably fastening the various components of the present wall system may be employed. Further, whereas aluminum is preferably employed as the material of construction for the channel member and cap members of the present invention, other suitable, preferably non-combustible, materials may be employed. Accordingly, it is intended that the present invention be limited only as set forth in the claims appended hereto.

As desired, the top ends of the standards and/or the top rail may be covered with an elongated cap 190 of generally U-shaped cross section such that the side webs 192, 194 thereof depend alongside, and cover, the top ends of the standards on either or both faces of a wall section. In similar manner the distal ends 196 of the horizontal connector rails 52' may be covered with a cap 198.

Having thus described the aforementioned invention, I claim:

1. A free-standing wall structure system having front and rear faces comprising:

a plurality of horizontal members each defined by a plurality of horizontal rails and including at least an elongated bottom rail and an elongated top rail, each of said plurality of horizontal rails defining first and second opposing faces, each of said plurality of horizontal rails defining a length independent of each other of said plurality of horizontal rails, said horizontal member defining an adjustable length by orienting said plurality of horizontal rails in an alternating manner between a first orientation and a second orientation, said plurality of horizontal rails being overlapped in an end-to-end manner and secured conventionally;

a plurality of first upright supports configured to engage said first face of said elongated bottom rail and said first face of said elongated top rail, each of said plurality of first upright supports being independently spaced with respect to each other of said plurality of first upright supports, each of said plurality of first upright supports defining a securement web configured to engage said plurality of horizontal members and a strengthening web extending from said securement web;

a plurality of second upright supports configured to engage said second face of said elongated bottom rail and said second face of said elongated top rail, each of said plurality of second upright supports being independently spaced with respect to each other of said plurality of second upright supports and with respect to said plurality of first upright supports, each of said plurality of first upright supports defining a securement web configured to engage said plurality of horizontal members and a strengthening web extending from said securement web; and said free-standing wall structure system being adapted to receive at least one substantially planar panel member interposed between said stregthening web of adjacent ones of either of said plurality of first upright supports and said plurality of second upright supports, each of said at least one panel member defines a width independent of said length of each of said plurality of horizontal rails.

2. The free-standing wall structure system of claim 1 wherein each of said plurality of horizontal rails is configured to define a substantially U-shaped transverse cross section.

3. The free-standing wall structure system of claim 1 wherein each of said plurality of first upright supports and said plurality of second upright supports is configured to define a transverse cross section selected from at least a substantially U-shaped configuration and a substantially T-shaped configuration.

4. The free-standing wall structure system of claim 1 wherein each of said plurality of horizontal rails is oriented substantially parallel with and spaced apart from each other of said plurality of horizontal rails.

5. The free-standing wall structure system of claim 4 wherein said plurality of first upright supports and said second plurality of upright supports are oriented substantially vertically and spaced apart from one another and extend between said elongated bottom rail and said elongated top rail, said free-standing wall structure system further comprising a securement mechanism for securing said plurality of first upright supports and said second plurality of upright supports to each of said elongated bottom rail and said elongated top rail.

6. The free-standing wall structure system of claim 5 further comprising a further free-standing wall structure system of like construction associated with said free-standing wall structure system.

7. The free-standing wall structure system of claim 6 further comprising a connector for connecting said elongated bottom rail and said elongated top rail of each of said free-standing wall structure system and said further free-standing panel wall system to one another.

8. The free-standing wall structure system of claim 1 further comprising a registration mechanism for registering either of said plurality of first upright supports and said plurality of second upright supports with each of said plurality of horizontal rails.

9. The free-standing wall structure system of claim 8 wherein said registration mechanism includes:

a plurality of equally spaced-apart first openings defined along each of said first and second opposing faces of each of said plurality of horizontal rails;

at least one second opening defined in each of said plurality of first upright supports for cooperating with at least one of said first openings defined in said first face of each of said plurality of horizontal rails;

at least one second opening defined in each of said plurality of second upright supports for cooperating with at least one of said first openings defined in said second face of each of said plurality of horizontal rails; and a plurality of fasteners for securing each of said first upright supports to said first face of each of said plurality of horizontal rails, and for securing each of said second upright supports to said second face of each of said plurality of horizontal rails, whereby each of said plurality of first upright supports is selectively positioned such that said at least one second opening cooperates with a selected one of said plurality of first openings defined along said first face of each of said plurality of horizontal rails to receive one of said plurality of fasteners, and whereby each of said plurality of second upright supports is selectively positioned such that said at least one second opening cooperates with a selected one of said plurality of first openings defined along said second face of each of said plurality of horizontal rails to receive one of said plurality of fasteners.

10. The free-standing wall structure system of claim 9 wherein said at least one second opening defined in each of said plurality of first upright supports includes a plurality of equally spaced-apart second openings, and wherein said at least one second opening defined in each of said plurality of second upright supports includes a plurality of equally spaced-apart second openings, whereby each of said plurality of horizontal rails is selectively positioned along each of said plurality of first upright supports and each of said plurality of second upright supports.

11. A free-standing wall structure system having front and rear faces comprising:

a plurality of horizontal members each defined by a plurality of horizontal rails and including at least an elongated bottom rail and an elongated top rail, each of said plurality of horizontal rails defining first and second opposing faces, each of said plurality of horizontal rails being oriented substantially parallel with and spaced apart from each other of said plurality of horizontal rails one another, each of said plurality of horizontal rails defining a length independent of each other of said plurality of horizontal rails, said horizontal member defining an adjustable length by orienting said plurality of horizontal rails in an alternating manner between a first orientation and a second and opposing orientation, said plurality of horizontal rails being overlapped in an end-to-end manner and secured conventionally;

a plurality of first upright supports configured to engage said first face of said elongated bottom rail and said first face of said elongated top rail, each of said plurality of first upright supports being independently spaced with respect to each other of said plurality of first upright supports, each of said plurality of first upright supports defining a securement web configured to engage said plurality of horizontal members and a strengthening web extending from said securement web;

a plurality of second upright supports configured to engage said second face of said elongated bottom rail and said second face of said elongated top rail, each of said plurality of second upright supports being independently spaced with respect to each other of said plurality of second upright supports and with respect to said plurality of first upright supports, each of said plurality of first upright supports defining a securement web configured to engage said plurality of horizontal members and a strengthening web extending from said securement web;

said free-standing wall structure system being adapted to receive at least one substantially planar panel member interposed between adjacent ones of either of said plurality of first upright supports and said plurality of second upright supports, each of said at least one panel member defines a width independent of said length of each of said plurality of horizontal rails; and a registration mechanism for registering either of said plurality of first upright supports and said plurality of second upright supports with each of said plurality of horizontal rails, said registration mechanism including:

a plurality of equally spaced-apart first openings defined along each of said first and second opposing faces of each of said plurality of horizontal rails;

a plurality of equally spaced-apart second openings defined in each of said plurality of first upright supports for cooperating with at least one of said first openings defined in said first face of each of said plurality of horizontal rails;

a plurality of equally spaced-apart second openings defined in each of said plurality of second upright supports for cooperating with at least one of said first openings defined in said second face of each of said plurality of horizontal rails; and a plurality of fasteners for securing each of said first upright supports to said first face of each of said plurality of horizontal rails, and for securing each of said second upright supports to said second face of each of said plurality of horizontal rails, whereby each of said plurality of horizontal rails is selectively positioned along each of said plurality of first upright supports and each of said plurality of second upright supports, whereby each of said plurality of first upright supports is selectively positioned such that a selected one of said plurality of second openings cooperates with a selected one of said plurality of first openings defined along said first face of each of said plurality of horizontal rails to receive one of said plurality of fasteners, and whereby each of said plurality of second upright supports is selectively positioned such that a selected one of said plurality of second openings cooperates with a selected one of said plurality of first openings defined along said second face of each of said plurality of horizontal rails to receive one of said plurality of fasteners.

12. The free-standing wall structure system of claim 11 wherein each of said plurality of horizontal rails is configured to define a substantially U-shaped transverse cross section.

13. The free-standing wall structure system of claim 11 wherein each of said plurality of first upright supports and said plurality of second upright supports is configured to define a transverse cross section selected from at least a substantially U-shaped configuration and a substantially T-shaped configuration.

14. The free-standing wall structure system of claim 11 wherein said plurality of first upright supports and said second plurality of upright supports are oriented substantially vertically and spaced apart from one another and extend between said elongated bottom rail and said elongated top rail, said free-standing wall structure system further comprising a securement mechanism for securing said plurality of first upright supports and said second plurality of upright supports to each of said elongated bottom rail and said elongated top rail.

15. The free-standing wall structure system of claim 14 further comprising a further free-standing wall structure system of like construction associated with said free-standing wall structure system.

16. The free-standing wall structure system of claim 15 further comprising a connector for connecting said elongated bottom rail and said elongated top rail of each of said free-standing wall structure system and said further free-standing wall structure system to one another.

* * * * *